United States Patent [19]

Humphreys

[11] 4,243,284

[45] Jan. 6, 1981

[54] ELECTRICAL DISTRIBUTION SYSTEM

[76] Inventor: Michael Humphreys, 135 Cavendish Ave., Ealing, London W.13, England

[21] Appl. No.: 57,540

[22] Filed: Jul. 13, 1979

[30] Foreign Application Priority Data

Jul. 21, 1978 [GB] United Kingdom ..... 30620/78

[51] Int. Cl.[3] ..... H01R 13/44; H01R 25/00

[52] U.S. Cl. ..... 339/21 R; 339/43; 339/99 R

[58] Field of Search ..... 339/20, 21 R, 22 R, 339/22 B, 40, 42, 43, 97 R, 97 P, 99 R, 103 R, 107

[56] References Cited

U.S. PATENT DOCUMENTS

| | | | |
|---|---|---|---|
| 776,855 | 12/1904 | La Har | 339/42 |
| 1,271,478 | 7/1918 | Krantz | 339/43 |
| 2,042,105 | 5/1936 | Kelley | 339/40 |
| 2,243,990 | 6/1941 | Thorn et al. | 339/40 |
| 3,316,523 | 4/1967 | Trangmar | 339/107 |
| 3,430,187 | 2/1969 | De Man et al. | 339/103 R |
| 3,503,032 | 3/1970 | Routh et al. | 339/21 R |
| 4,143,935 | 3/1979 | Goodman et al. | 339/99 R |

FOREIGN PATENT DOCUMENTS

| | | | |
|---|---|---|---|
| 558476 | 6/1958 | Canada | 339/21 R |

OTHER PUBLICATIONS

Western Electric, Technical Digest No. 44, Dix, p. 19, 10-1976.

*Primary Examiner*—Neil Abrams
*Attorney, Agent, or Firm*—Krass & Young

[57] ABSTRACT

The invention comprises an electrical distribution system in which the electrical conductors are enclosed within a length of hollow conduit which is formed with a continuous slot in one wall through which a plug can be inserted and rotated to bring its contact pins into contact with the conductors. Gate means located within the conduit have a normally closed position in which the conductors are closed off from that part of the conduit containing the slot, and these are movable into the open position by entry of the plug through the slot. By closing off the conductors from the remainder of the conduit, accidental contact with the conductors is prevented even though access to the interior of the conduit may be achieved via the slot. In one embodiment of the invention, a keyway is provided in the conduit and the plug is formed with a corresponding projection which engages the keyway when the plug is fitted into the slot. The gate means is arranged such that it can only be opened by an element passing through the keyway, thus providing an additional safety feature.

28 Claims, 9 Drawing Figures

14
14a
10
11
12
20
28
29
50
52
120
122
123
124
125
127
128
130
132
133
134
140
141
121
150
151
32
40

25
29
41
34
26
27
28
22
71
14
92
16a
11
15
10
12
78
72
19
18
16
30
50
89
32
48
77
23
75
90
40
20
35
52
112
80
66
55
88
64
24
65
26
58
28
27
54
25
29

ELECTRICAL DISTRIBUTION SYSTEM

BACKGROUND OF THE INVENTION

Electrical distribution systems are known in which the electrical conductors are enclosed within a length of hollow conduit. The conduit is formed with an aperture in the form of a longitudinally extending continuous slot in one wall, and a plug is provided which has a part incorporating electrical contact pins which part can be inserted through the slot and then rotated to bring the contact pins into contact with the conductors enclosed within the conduit.

Such an arrangement has many advantages over conventional ring main circuits which are provided with a limited number of socket outlets, as the continuous conduit can be mounted for example above a skirting board or a work surface to provide a far greater number of locations in which a plug can be fitted. This substantially reduces the length of flexible electrical cable required for individual appliances and eliminates the need for adaptors which are unsightly and which sometimes present a fire hazard.

Known electrical distribution systems of this kind have all suffered from relatively serious drawbacks from the point of view of safety. Most of the systems previously proposed have an arrangement whereby a flap or door is provided across the aperture, and once this door has been opened, access to the interior of the conduit, and therefore the conductors, can be achieved. In some constructions, it is possible for a child directly to touch the conductors once the aperture door is opened; in others this can be achieved if an element of electrically conductive material is pushed inside the conduit.

The present invention provides an electrical distribution system comprising a continuous conduit in which these disadvantages are minimised or substantially eliminated.

SUMMARY

The present invention provides an electrical distribution system comprising a hollow conduit containing a plurality (i.e. two or more) of continuous electrical conductors, a longitudinally-extending aperture in a wall of the conduit to allow access to the interior thereof at any one of a number of locations, and gate means located within the conduit and being movable from a normally closed position in which the gate means closes off that part of the conduit containing the conductors from that part of the conduit in which the aperture is located, to an open position in which access to the conductors via the aperture can be achieved.

The safety features inherent in this arrangement will be readily appreciated. Whilst the gate means closes off that part of the conduit containing the conductors, accidental contact with the conductors is prevented even though access to the interior of the conduit is possible via the aperture. Thus, where a child may achieve entry to the conduit via the aperture, the child cannot make contact with the conductors disposed within the conduit because they are protected by the gate means.

In a preferred embodiment of the invention, the gate means is movable between its closed and open positions in response to the action of an element inserted through the aperture, and the arrangement is such that the direction of movement required of the element to open the gate means is not the same as would be required to contact the conductors; thus contact between the element and the conductors is possible only by means of two consecutive movements of the element in different directions, the first of which must open the gate means.

This additional safety feature prevents the gate means from being opened by inserting an element through the aperture in the direction of the conductors, i.e. by a simple movement in one direction. In order to achieve access to the conductors, the gate means must first be opened by movement in one direction, and this then must be followed by movement in another direction before contact with the conductors is possible.

Suitably, the aperture comprises a continuous longitudinal slot formed in one wall of the conduit; advantageously the conduit is of generally rectangular cross-section and the slot is formed in one of the broader walls thereof, the continuous conductors being disposed so as to extend longitudinally and in parallel within the conduit adjacent one of the narrower walls. Although the preferred shape in section for the conduit is rectangular, it will be appreciated that other shapes may be employed, for example the conduit may be square, circular, semicircular or polygonal in section.

The distribution system of the invention suitably includes a connecting plug which includes a part adapted for insertion through the aperture which part has a plurality of electrical connectors or contact pins, whereby insertion of the part through the aperture opens the gate means and rotation of the connecting plug then causes the contact pins to contact the respective conductors within the conduit. Suitably the connecting plug comprises a plug body, a neck porton protruding from the plug body, and a head member (which is the part for insertion through the aperture) extending substantially at right angles to the neck portion and carrying at its free end said electrical contact pins for contact with the conductors.

In a preferred form of the invention the wall of the conduit containing the longitudinal aperture is provided at intervals along its length with additional passageways communicating with the interior of the conduit, and the connecting plug is formed with a corresponding projection, whereby when the plug is inserted into the aperture, the projection is engaged with a passageway and the gate means is opened by abutment with said projection as the plug is pushed in.

Each of these passageways thus acts as a keyway which, when the plug is inserted, receives the projection on the plug. The gate means is arranged such that it can only be opened by abutment with an element passing through the passageway, thus making access to the conductors by an element other than the correct plug even more difficult.

Suitably, the gate means comprises a series of individual juxtaposed cover plates each of which is located within the conduit opposite one of the passageways, and these may be formed from a continuous strip of resilient material such as plastics material or spring steel which is partially or completely divided at intervals along its length. These individual cover plates are aligned so that their central portions are engaged by the projection on a plug when it is fitted into the respective passageway. These passageways may be formed in the respective wall of the conduit nearest the conductors, immediately adjacent the edge of the aperture and extending into the aperture; alternatively, they may be formed as passageways which are separate from the main aperture. Alternative arrangements for the gate means are equally possible. For example, the individual cover plates can be hinged within the conduit, and biassed into the closed position by means of separate springs. Instead of individual juxtaposed cover plates, a continuous undivided length of flexible material (e.g. flexible plastics material) can be used, and where the conduit itself is moulded from plastics material, this length of plastics material may be moulded integrally with it.

Suitably, door means are provided in addition to the gate means within the conduit, adapted to extend in their closed position across the continuous slot, and these door means may comprise a series of individual cover doors corresponding in number and position to the passageways formed in the wall of the conduit; suitably they are biassed into their closed position by spring means. These individual cover doors together with the appropriate passageways define individual locations for the plug member and each door is suitably of sufficient length to allow passage of the head element of the connecting plug through the aperture and into the interior of the conduit, but shorter than the overall width of the plug body when the plug is rotated into its contact position. In this manner, the opening in the continuous slot revealed by the door when the plug is fitted into the conduit is completely covered by the plug body when the plug is in its contact position, thus preventing access to the conductors at either side of the plug. These door means may be formed in a similar manner to that described in relation to the embodiments of the gate means. Where the door means comprises a single continuous flap of flexible material, this must be sufficiently flexible to ensure that the openings on either side of the head element are completely covered by the plug body in the contact position.

In an embodiment of the invention, the conduit is formed from electrically conductive material and the plug member is provided with an earth contact pin or connector adapted to be held in contact with one of the conduit walls when the plug member is in its contact position. In this embodiment, the continuous conductors are necessarily located within the conduit in an electrically insulating support. Clearly, the conduit may be made from an insulating material such as PVC or other plastics material, and in this case a separate earth conductor is required.

Conventional electrical connecting plugs for example for use with a ring main system are generally provided with two or more contact pins which are connected within a part of the plug body to terminal connectors adapted to receive the insulated cables of the electrical flexible cable leading to the appropriate appliance. These terminals generally comprise a metal fitting having a bore to receive the cable or cord conductor, and a screw which is threaded into the fitting which is used to grip the conductor so as to provide an electrical connection with the contact pins. The design of the terminal connectors dictates that the outer covering must first be stripped off the flexible cable and the individual core insulation for each conductor then removed to expose the ends of the conductors. Once this has been done, the conductor ends can be fitted into the terminal connectors and the screw is tightened to achieve the required electrical and physical connection. This operation is a tedious and time-consuming task which if incorrectly or improperly carried out can result in inadequate and hence dangerous connections within the plug body.

The connecting plug of the invention may be provided with a novel arrangement for making such connections, wherein the plug body is formed from at least two separable parts one of which is provided with contact pins, and conductor connector means are located in the plug body adapted to provide for the connection of electrical cable to at least one of said contact pins, said conductor connector means comprising a cutting element of electrically conductive material adapted to cut through the core insulation outer sleeve of a cable and to make electrical contact with the conductor therein.

This arrangement eliminates the need for stripping the core insulation of a flexible cable from the conductor within and provides a much simpler and hence safer manner of making connections to an electrical plug.

Suitably, the cutting element is adapted to cut through the core insulation and make electrical contact with the conductor when the core is pushed into contact therewith, and the parts of the plug body are shaped to perform this operation when the plug is assembled. Thus, it is simply necessary for the user to assemble the ends of the flexible cable into a part of the plug body, and then assemble the parts of the plug (which may be secured together for example by screws) to make the necessary electrical contact.

Advantageously, one of the body parts is provided with at least two contact pins and a corresponding number of cutting elements each connected to a respective contact pin, and the second body part comprises a cover which when closed forces the conductors into contact with the cutting elements. Suitably the cutting elements comprise substantially V-shaped cutting teeth adapted to receive a core between their converging cutting edges, and projection means are provided on the cover adapted when the cover is closed to force the core into cutting contact with the teeth. Suitably, these projections comprise similar V-shaped cutting teeth to those provided on the other body part, and these similar V-shaped cutting teeth are adapted to engage the core at a point immediately adjacent the corresponding cutting teeth in the other body part when the plug is assembled.

All electrical plugs are provided with cable or cord grips adapted to secure the outer covering of the flexible cable into the plug body and thus prevent the inner cores from being pulled out of contact with the terminal connectors when a strain is applied to the flex. These cable grips generally comprise a clamp which is mounted in one of the parts of the plug by means of screws and which can be tightened over the cable outer covering when the cable has been fitted into the plug. In a preferred form of the plug according to the invention, cable grip means are located between the body parts of the plug comprising a hollow frusto-conical member of resilient plastics material through the centre of which a covered electrical cable can be threaded, axially-extending slits being provided in the wall of the frusto-conical member around the narrowest part thereof so as to form said wall into segments adapted to grip the outer covering of a cable and prevent the cable being pulled axially through the member in a direction away from the plug body. Suitably, this member is formed in two separate parts each of which is located in respective body parts of the plug, although it may equally be formed in one piece.

While the connecting plug intended for use with the electrical wiring system of the present invention advantageously has the features described above, it will be appreciated that conventional cable connectors and cable grips may also be used in the plug of the invention.

DESCRIPTION OF THE PREFERRED EMBODIMENTS

Figures 1, 1A, 1B:
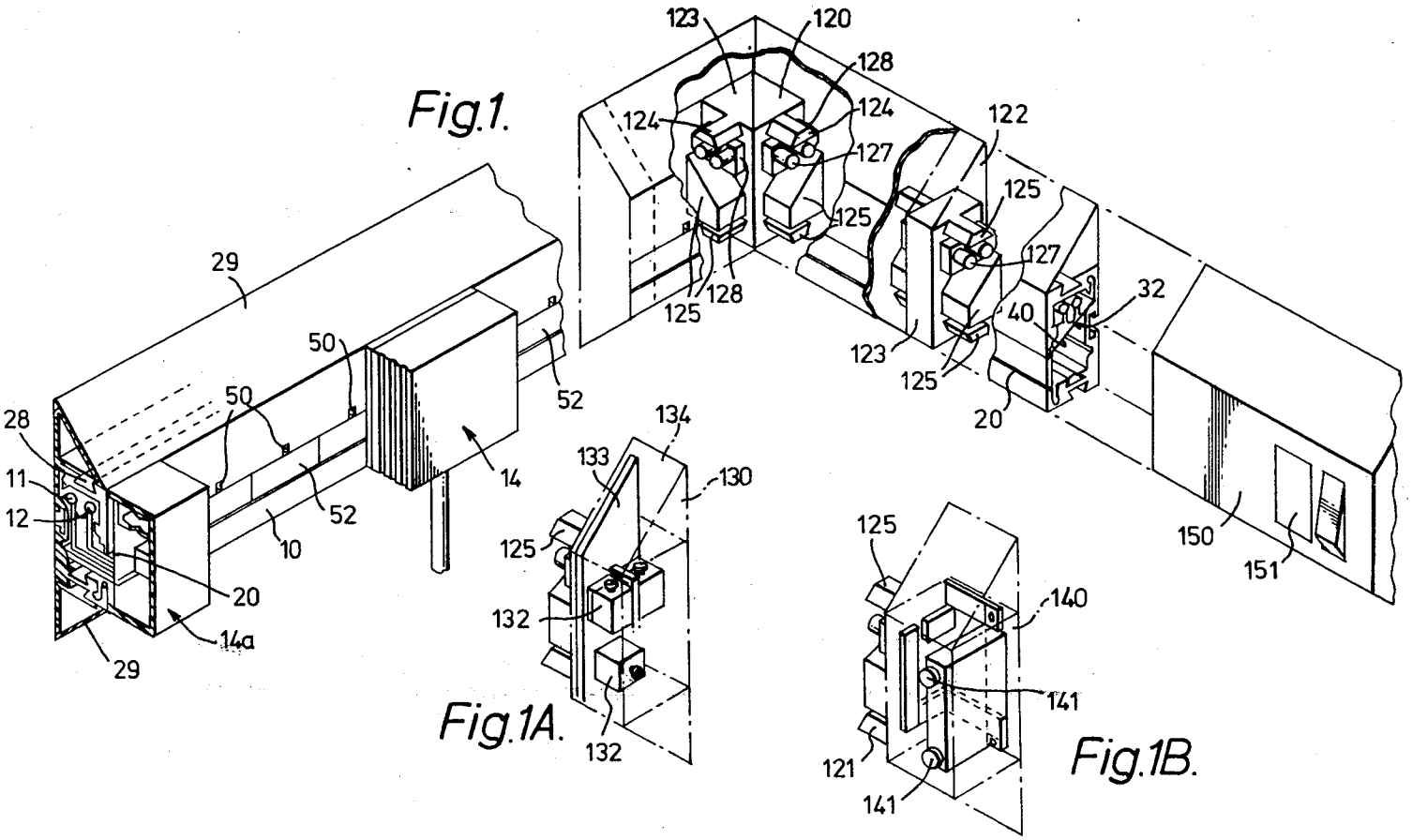
FIG. 1 shows a perspective partially sectional view of the electrical distribution system of the present invention, showing several lengths of conduit with plugs fitted thereto, FIGS. 1A and 1B showing additional features of the system.
Figure 5:
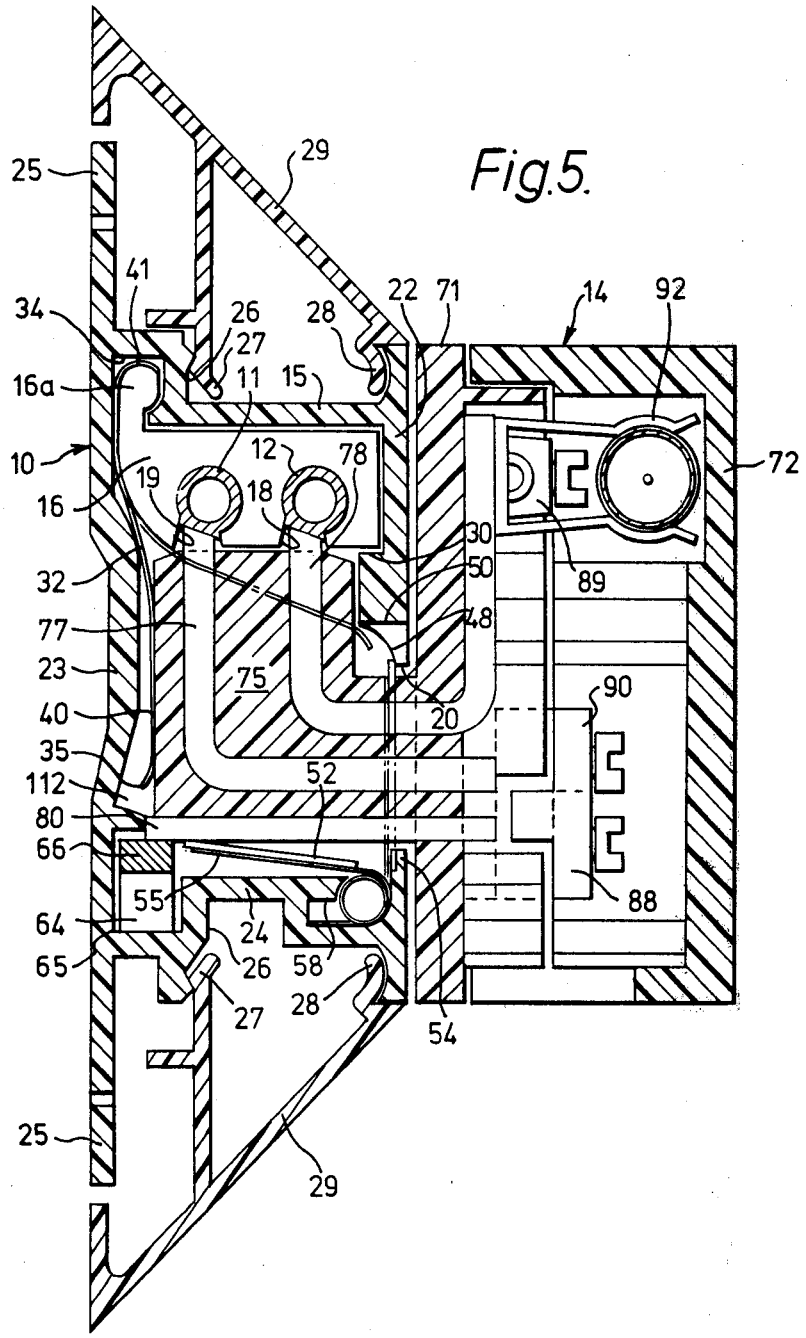
FIG. 5 shows a vertical sectional view taken through a section of conduit with a plug fitted thereto.

Referring to the drawings, and in particular to FIGS. 1 and 5, the basic components of the electrical distribution system illustrated comprise a length 10 of hollow conduit in which are supported a pair of continuous electrical conductors 11 and 12, and a plug 14 which is shown in its contact position in these Figures. A second plug 14a is shown partially in section in FIG. 1.

The conductors 11 and 12 extend longitudinally within the conduit and are supported adjacent an upper wall 15 of the conduit in an elongate supporting element 16 formed from an electrically insulating material such as PVC or other synthetic plastics material. The conductors consist of lengths of electrically conductive rod or tube such as brass, copper or aluminium and are retained in continuous channels 19, 18 respectively formed for that purpose in the supporting element 16. These conductors are shown in FIG. 5 as basically circular-section with flattened contact surfaces, but they may have any other suitable cross-section.

In the embodiment shown, the conduit 10 is formed from electrically conductive material and suitably comprises an extruded aluminium section. As will be seen from the drawings, it is of generally rectangular form, having an upper wall 15, a front wall 22, rear wall 23, and base 24; it is normally intended to be mounted in a horizontal position on a wall surface as shown in FIG. 1, although it may be mounted vertically or in any intermediate position where required. In addition, the conduit can be mounted on a flat horizontal surface such as a ceiling or on the underside of a cupboard unit, or at any inclined angle.

The rear face 23 of the conduit is provided with continuous flanges 25 which are provided with holes through which screws may be inserted to secure the conduit to a wall surface; the upper and lower walls 15 and 25 are each formed with a continuous shaped slot 26 which can be engaged with correspondingly-shaped longitudinal projections 27 and 28 formed along one edge of a trim element 29 which can be fitted to the upper and lower walls of the conduit to improve the external appearance. These trim elements are suitably formed from a metal such as aluminium alloy, or a synthetic plastics material. They may be used to enclose supply cables to the track, or speaker or telephone wires.

The front wall 22 of the conduit is provided with an aperture in the form of a continuous slot 20 extending longitudinally of the conduit immediately above the base 24.

The conduit is primarily intended to be used in a domestic ring main system and the conductors 11 and 12 comprise the neutral and live current-carriers respectively. The metal construction of the conduit enables the conduit to act as the earth continuity conductor, although it will be appreciated that as in the embodiment illustrated, a separately-insulated earth continuity conductor can be provided to improve the earth contact; this is essential if the conduit is formed from an insulating material such as plastics. While, as stated, the conduit is primarily for use in domestic situations, it will be appreciated that it can be used in other applications in which a greater number of conductors could be contained within the conduit, e.g. carrying a three-phase supply in an industrial application.

The conduit section is formed integrally with a series of passageways and slots which perform various locating and retaining functions as will be described. Front wall 22 includes on its rear face a ledge 30 which supports the front edge of the element 16; the rear edge of the element 16 is supported by abutment with a spring plate 32 and by the provision of a nose portion 16*a* which is received in a continuous channel 34 formed in the conduit section and which also serves to locate the captive end of spring plate 32.

The spring plate 32 comprises one of a series of juxtaposed plates of resilient material such as spring steel which constitute gate means for restricting access to the conductors 11 and 12 via the aperture 20. In the embodiment shown in FIG. 5, these plates are individually formed from sheet steel, but in an alternative form they may comprise a continuous strip of plastics material which is divided at intervals over approximately two-thirds of its width by lateral slits, thus forming a series of individually sprung plates. Each spring plate 32 is provided with a web 40 having a rounded edge 41 which is received within the continuous channel 34, and located by the nose portion 16*a* of element 16. Each spring plate 32 extends in its closed position (shown in broken lines in FIG. 5) across the conductors 11 and 12, thus dividing the interior of the conduit into two parts, one part containing the conductors and the other part containing the slot 20. In this manner, access to the conductors is prevented even though entry into the interior of the conduit can be achieved via the slot 20. It will be appreciated that while the juxtaposed spring plates 32 form a substantially continuous barrier across the conductors, each spring plate operates separately and can be opened and closed individually without moving the position of adjacent spring plates.

In the closed position of the spring plates 32, the free edge 35 of each spring plate is received in a continuous rounded channel 48 formed in the conduit immediately adjacent the upper edge of the slot 20. This channel conmunicates with the outside of the conduit by means of small passageways 50 which are formed at intervals along the slot 20 and which define entry positions for a plug 14. In the embodiment shown in the drawings, these apertures open into the slot 20, although this is not essential.

Associated with these entry positions are a series of individual juxtaposed flap doors 52 which are substantially the same width as each spring plate 32 and which are located within the conduit in their closed position by abutment along their upper edges with the channel 48 and along their lower edges with an upstanding wall element 54; they are biassed into their closed positions (shown in broken lines in FIG. 5) by springs 55, one spring 55 being provided for each door 52. The springs 55 are received in a continuous channel 58 formed in the conduit section, and act to maintain the flap doors in their normally closed position shown in FIG. 1.

Instead of individually sprung flap doors 52, the slot 20 may be closed by a continuous cover of flexible material e.g. synthetic plastics material which can be deformed into the open position and which returns to the closed position after it is released. Where the conduit is moulded from a plastics material, these continuous covers can be extruded integrally with the conduit.

As will be described, the flap doors 52 are displaced into their open position (shown in FIG. 5) when a plug is inserted into the slot 20. In this position, the springs 55 are deformed as shown into the space provided in the base of the conduit 10.

In addition to the spring plates 32 and springs 55, a continuous, corrugated spring 64 is located in a slot 65 formed in the base 24 of the conduit. This spring 64 supports an earth conductor 66 of brass or similar material which ensures good earth continuity between the conduit and the plug; as will be described, corrugated spring 64 also biasses the plug into contact with the conductors 11 and 12 and assists in the ejection of the plug from the slot 20 after disconnection.

Figure 3:
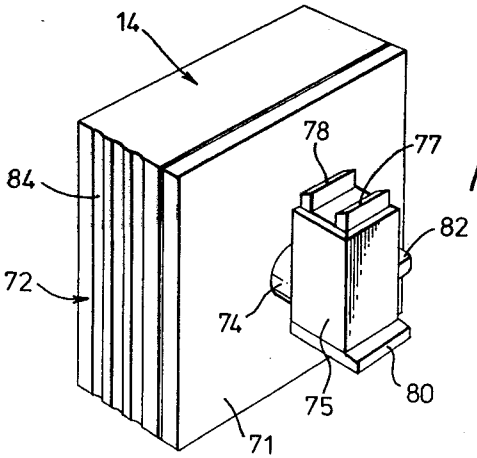
FIG. 3 shows an isometric view of the plug intended for fitting into the conduit shown in FIGS. 1 and 2.
Figure 4:
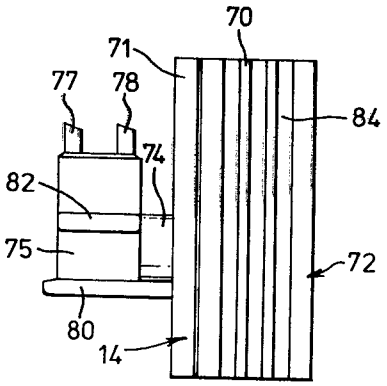
FIG. 4 shows a side elevation of the plug shown in FIG. 3.

The plug is illustrated in detail in FIGS. 3 and 4. It comprises a plug body 70 consisting of a base 71 and a detachable cover 72, a generally cylindrical neck portion 74 protruding from the base 71, and a head member 75 which extends substantially at right angles to the neck portion 74 and which is provided with a pair of contact pins 77 and 78 having exposed ends which are shaped respectively to engage the continuous conductors 11 and 12 within the conduit 10. An earth contact pin 80 is located on the opposite end of the head member, and between the contact pins there is provided a moulded projection 82 which extends transversely across the head member.

With the exception of the contact pins and the associated terminal connectors, the plug is moulded from a material such as Bakelite, high impact polystyrene, PVC, nylon or other synthetic or thermoplastic material, and the neck portion and head member are moulded integrally with the base 71. The cover 72 is provided with a ridged gripping surface 84 on either side and is secured to the base by screws passing through holes which engage captive nuts moulded into the cover 72.

As will be seen from FIG. 5, the terminals 77, 78 and 80 extend within the head member 75 and neck portion 74 into the base 71, where they are connected to conventional terminal connectors 88, 89 and 90 respectively mounted on the base 71. The live cable connector 89 incorporates a fuse holder 92.

The operation of fitting a plug 14 into the conduit 10 will now be described with reference to FIGS. 1 to 5.

In order to gain entry into the interior of the conduit 10, the plug must first be turned on its side from the position as shown in FIG. 3 so that the projection 82 is uppermost on the head member 75. This position is shown at A in FIG. 2. In this position, the projection 82 can be fitted into the appropriate passageway 50 and the head member 75 can pass through the continuous slot 20 into the interior of the conduit, pushing open the appropriate door 52. As the plug is pushed into the slot 20, the end face of the projection 82 engages the edge of the spring plate 32 located opposite the keyway 50, and further movement of the plug pushes the spring plate 32 away from its shielding position across the interior of the conduit. At the same time, the respective door 52 is pushed downwards by the earth contact 80 of the plug 14, the spring 55 yielding to allow entry of the head member; the earth pin 80 also pushes down earth conductor 66 against spring 64.

Figure 2:
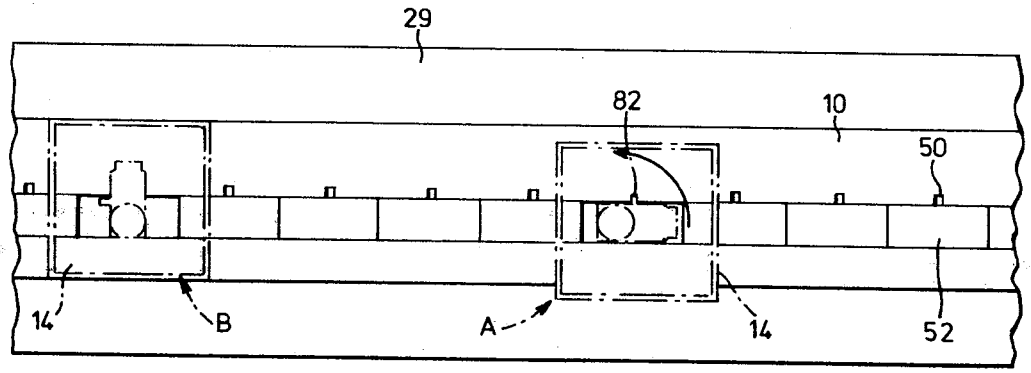
FIG. 2 shows a frontal elevation of the conduit illustrating insert and contact positions of the plug.

When the head member 75 has been pushed fully into the interior of the conduit, the earth pin 80 of the plug engages the rear wall of the conduit, and in this position the plug can then be rotated in an anti-clockwise direction into its contact position shown at B in FIG. 2 and in FIG. 5. In this position, the exposed ends of the contact pins 77, 78 engage the continuous conductors 11, 12 provided in the conduit, and good electrical contact is ensured by the combined effect of springs 55 and 64 which push the head member of the plug upwardly into contact with the conductors.

In the contact position of the plug, as will be seen in FIG. 5, the spring plate 32 is pushed against the rear wall 23 of the conduit, the free end lying within a passage 112 provided for that purpose in the rear wall.

The width of the plug body is sufficient to cover the length of slot revealed by the door 52 so that entry to the conduit via this opening is impossible whilst the plug is in its contact position.

Removal of the plug is the reverse of the above procedure. The plug is rotated through 90° (in a clockwise direction) into a position in which the head member can be withdrawn through the aperture 20. This is assisted by the biassing effect of the resilient springs within the conduit, which operate partly to eject the plug once it has been rotated into its withdrawal position.

The direction of rotation into and out of the contact position can be reversed by designing the plug with projection 82 on the opposite side to that shown in the drawings. Removal of the plug by rotation in the same (rather than the opposite) direction as insertion can be achieved if additional keyways 50 are located along the lower edges of aperture 20.

It will be seen from FIG. 5 that when the plug is in its contact position, the earth contact pin 80 contacts both conductor 66 and the rear wall 23 of the conduit, thus providing good earth continuity.

When the plug is removed from the conduit, spring plate 32 and flap door 52 automatically re-close to block off access to the conductors.

As will be seen from FIGS. 1 and 2, the provision of a continuous series of adjacent doors 52, keyways 50 and spring plates 32 ensure a substantial number of entry positions for a plug.

Figure 6:
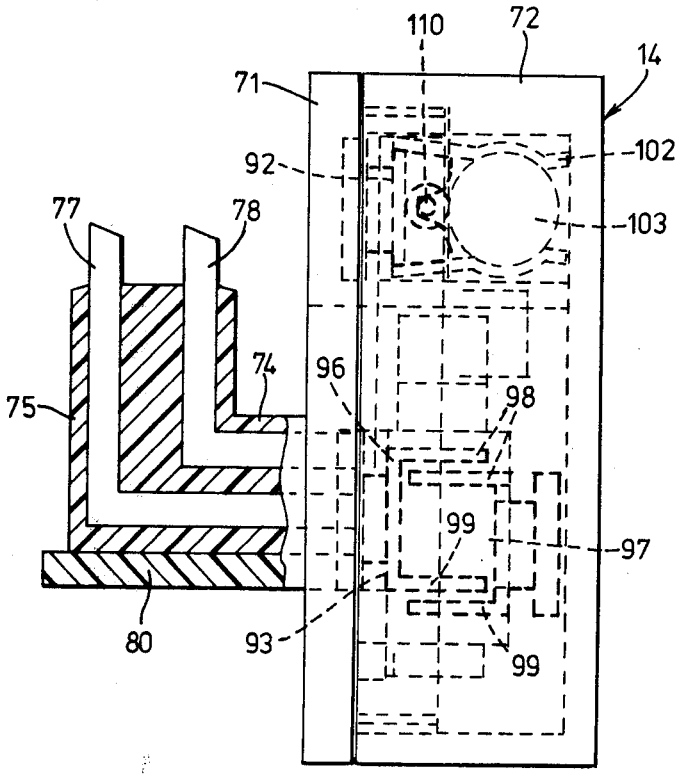
FIG. 6 shows a sectional view of a different embodiment of plug suitable for use with the continuous track.
Figure 7:
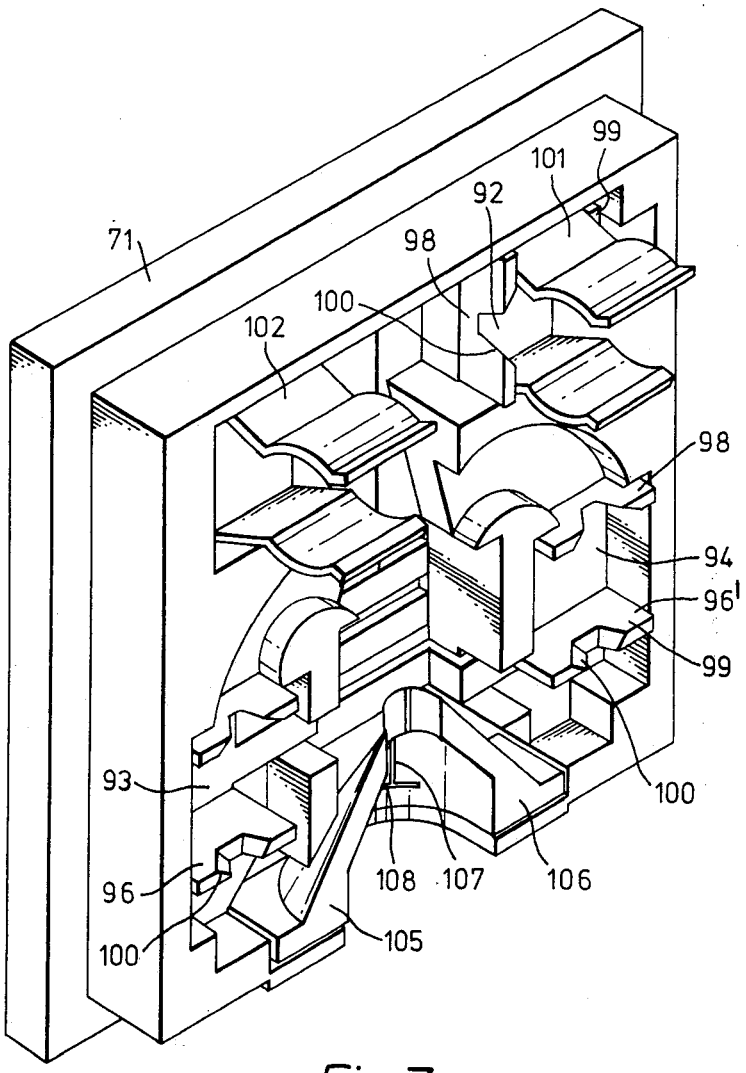
FIG. 7 shows an isometric view of the inside face of the plug base of the connecting plug shown in FIG. 6.

A variation of the plug which incorporates a novel terminal connector for making contact with the flexible cable or cord is shown in FIGS. 6 and 7. These terminal connectors can be seen more clearly from the schematic view of the base plate 71 shown in FIG. 7.

The earth and neutral terminal connectors 94, 93 are formed in two separate parts, one part 96, 96' being located in the base 71 and being connected to the appropriate conductive strip leading to the contact pin, and other part 97, 97' (97' not shown) being located in the cover 72. The two parts are substantially identical, and each part comprises a pair of cutters 98, 99 which are provided with V- or U-shaped cutting edges 100 which are capable of cutting through the core insulation when the core is forced against the cutting edges. When the base and cover of the plug are assembled together, the pairs of cutters of each part are located adjacent each other as shown in FIG. 6, in the manner of co-operating blades. The live terminal connector 92 is provided with a similar pair of cutters 98, 99 with cutting edges 100, but no corresponding pair is located in the cover 72. A fuse holder in the form of a pair of circular clips 101, 102 is secured within the base 71, the clip 101 being connectd to the terminal connector 98 while the clip 102 is connected to the conductive strip leading to the live contact pin 78.

The plug 14 is also provided with a novel cable grip in the form of a generally frusto-conical member 105, which in the embodiment shown is divided vertically about its central axis into two parts, one of which 106 is shown located in position in the base 71; the other part is located in a corresponding position in the cover 72. The member 105 is moulded from a resilient plastics material such as PVC, and each part 106 is provided with an axially directed slit 107 communicating with a transverse slit 108 in its upper wall so as to form the upper wall into gripping segments which can engage the outer covering of a flexible cable or cord aligned axially within the member 105. The upper wall of member 105 defined by the gripping segments forms an essentially circular opening, the diameter of which is less than the diameter of the outer covering of the flexible cable or cord which is to be passed therethrough. When the base 71 and cover 72 are joined together around the cable, the gripping segments of the resilient upper wall of member 105 engage the cable and are urged radially outward; by virtue of their resiliency, the gripping segments remain biased inwardly against the cable, thereby tending to grip and immobilize the cable within member 105.

It will be appreciated that the operation of connecting a flexible cable or cord to a plug 14 is considerably simplified as compared to conventional electrical plugs. The end of the outer covering of the cable is first removed to expose the insulated conductors, and the ends of these insulated conductors are then engaged within the V-shaped cutting edges 100 (FIG. 7) provided on the appropriate terminal connectors. The live connection is made first by pushing a fuse 103 (FIG. 6) into the fuse holders 101, 102 and this pushes the insulated conductor wire against the cutting edges 100 of the connector 92, cutting through the insulation and pressing the conductor core (shown at 110 in FIG. 6) into electrical contact with the respective cutting edges. The earth and neutral conductors are then laid into the appropriate terminal connectors 94 and 93 across each pair of cutters 98, 99, and the outer covering of the flexible cable or cord is fitted into the central aperture of the cable grip 105. The cover 72 is then fitted onto the base 71 and drawn against the base by the screws provided for that purpose; this operation engages the conductor cores between the overlapping cutting edges of the pairs of cutters 98, 99 fitted into the base part and the pairs of cutters disposed in the cover, thus cutting through the outer insulating sleeve and ensuring electrical contact between the terminal connectors and the conductive cores of the cables. The outer covering of the cable is gripped by the resilient wall portions of the cable grip member 105 thus preventing removal of the cable even if a strain is applied thereto.

The arrangement for making electrical connections within the plug using cutters 98, 99, and the cable grip 105 may equally be used in other forms of plug and electrical assemblies which are not intended to be used with the continuous track of the invention.

It will be appreciated that various fittings may be incorporated into the system in order to provide greater flexibility. Some examples of these fittings are shown in FIG. 1.

The most basic of these fittings is a connector piece which enables adjoining lengths of conduit to be interconnected in various modes. Two such connector pieces are illustrated in FIG. 1; the first of these is a corner connector 120 and the second a straight connector 122. The corner connector 120 comprises a connector body 123 of generally square cross-section which is provided on two ajdacent faces with interlocking formations 124, 125 which can be pushed into the ends of the slots 26 formed in the top and bottom walls of a conduit section. The connector body 123 is also provided with a pair of conductor connectors 127 in the same adjacent faces, and these connectors are provided at their ends with cylindrical sleeves which can be pushed over the ends of the continuous conductors 11 and 12 in the ends of the conduits to be joined. A shroud 128 is provided around the ends of these cylindrical sleeves to prevent contact therewith by for example a razor blade being pushed between the ends of the conduit sections and the connecting piece. As an alternative to these shrouds, one or both parts of the interengaging track sections can be formed with an internal lip which covers the gap between the sections. This lip may extend around the periphery of the sections, or simply around the conductors.

The corner connector 120 allows the conduit to extend around for example a 90° corner in a room, whilst providing electrical continuity; the straight connector 122 allows adjacent lengths of conduit to be joined with the same electrical continuity, and is constructed in a similar manner to the corner connector 120. It is provided with the same interlocking formations 125 adapted to engage within the conduit and within the slots 26 and similar connectors 127 which include sleeved ends arranged to fit over the conductors within the conduit.

It will be appreciated that the construction of these connecting pieces enables the conduit to be cut to any desired length and provides substantial flexibility for the system.

FIGS. 1A and 1B illustrate fittings for the conduit which can be attached to the end of a conduit section in the same manner as described in relation to connectors 120 and 122. FIG. 1A comprises a terminal piece 130 used for connecting the conduit into the mains supply wiring system. The terminal piece incorporates terminal connectors 132 for connection to the mains supply.

FIG. 1B shows a circuit breaker fitting 140 which is used to protect a length of conduit section. The circuit breaker assembly is constructed in a similar manner to the terminal piece 130 and is provided with re-set buttons 141 on its front face.

A mains switch and connector assembly is shown at 150 in FIG. 1 and this is fitted into the conduit in the same manner as that described for connectors 120 and 122. The connector 150 incorporates a neon indicating light 151 and a switch 152.

The fittings 130 and 150 may utilise similar cable connectors to those described for the plug shown in FIGS. 6 and 7, that is they may incorporate the V-shaped cutters which cut through the cable covers to make contact with the wires inside. They may also be provided with a cable grip similar to cable grip 156.

With all the accessories and connectors described, earth continuity is ensured by contact between adjacent conduit lengths or by means or earth conductors provided in the connectors.

It will be appreciated that other accessories and fittings may be used with the system described. For example, light fittings which plug directly into the conduit may replace or be provided in addition to plug 14, and many other configurations of connecting pieces may be used such as T-connectors which can feed separately-protected spur systems. The system described is capable of carrying a current load of up to 50 amps, which means that it will accept a greater number of plugs and fittings than may be currently provided in a conventional ring mains system.

Many variations of the arrangements described are possible within the scope of the appended claims. For example, in order to improve the electrical contact of the live and neutral pins of the plug with the continuous conductors, each of the conductors can be formed with a continuous longitudinal channel which receives the ends of the pins when the plug is rotated into the contact position. Furthermore, while the keyways 50 provide an additional safety feature, they are not essential and instead the spring plates 32 may extend beyond the upper edge of the slot 20 where they are engaged directly by the plug body when it is pushed into the slot 20.

Although the distribution system of the invention has been described as applied primarily to a domestic distribution system, applications in other fields are also envisaged. For example the system may be used in industrial, commercial, automotive, marine or aeronautic applications, and it may be employed as a single outlet or a multiple outlet system or in a radial, spur or ring main arrangement.

I claim:

1. An electrical distribution system, comprising a hollow conduit, a plurality of continuous electrical conductors disposed within a first region of the conduit, a longitudinally-extending aperture in one wall of a second region of the conduit spaced from said first region, said aperture communicating with and allowing access to said second region of the interior thereof opposite the conductors at any one of a number of locations, the conductors being transversely offset from a reference axis extending perpendicular to the aperture and into said second region of the conduit, and gate means located within the conduit and being movable from a normally closed position in which the gate means protectively partitions the first region of the conduit from the second region thereof to deny access to the conductors, but in which access to the second region of the conduit via the aperture can be achieved, to an open position in which access to the conductors via the aperture can be achieved.

2. An electrical distribution system as claimed in claim 1, wherein said one wall of the conduit containing the aperture includes a number of passageways therein extending transverse to said aperture and each communicating with the interior of the conduit, and said gate means is movable between its closed and open positions in response to the action of an element inserted through the aperture, said gate means including a plurality of individually shiftable cover plates each having a free outer edge disposed within the conduit opposite one of said passageways when said gate means is in its closed position.

3. An electrical distribution system as claimed in claim 1, wherein said aperture comprises a continuous longitudinal slot formed in one wall of the conduit.

4. An electrical distribution system as claimed in claim 3, wherein the conduit is of generally rectangular cross-section and said continuous slot is formed in one of the broader walls thereof, and said continuous conductors are disposed so as to extend in parallel relationship longitudinally within the conduit adjacent another of said walls.

5. An electrical distribution system as claimed in claim 1, further comprising a connecting plug having an element adapted for insertion through the aperture and which includes a plurality of electrical contact pins, whereby insertion of said element through the aperture opens the gate means and rotation of the plug causes said contact pins to contact the respective conductors within the conduit.

6. An electrical distribution system as claimed in claim 5, wherein said connecting plug comprises a plug body, a neck portion protruding from the plug body, and a head member extending substantially at right angles to the neck portion, said electrical contact pins being disposed at the free end of said head member for contact with the conductors.

7. An electrical distribution system as claimed in claim 6, wherein said one wall of the conduit containing the aperture is provided at intervals along its length with passageways communicating with the interior of the conduit, and the connecting plug is formed with a corresponding projection, whereby when the plug is inserted into the aperture, said projection is engaged with a passageway and said gate means is opened by abutment with said projection.

8. An electrical distribution system as claimed in claim 7, wherein the gate means comprises a series of individually movable and juxtaposed cover plates each of which is located within the conduit opposite one of said passageways.

9. An electrical distribution system as claimed in claim 8, wherein said individual cover plates are formed from a continuous strip of resilient material divided at intervals along its length.

10. An electrical distribution system as claimed in claim 7, wherein said passageways are formed in the respective wall of the conduit immediately adjacent the edge of the aperture nearest the conductors, and said passageways extend into the aperture.

11. An electrical distribution system as claimed in claim 3, wherein door means are provided adapted to extend in their closed position across said longitudinal slot.

12. An electrical distribution system as claimed in claim 8, wherein door means are provided adapted to extend in their closed position across said continuous slot, and said door means comprise a series of individual cover flaps corresponding in number and position to said gate means, and said cover flaps are biassed into their closed position by spring means.

13. An electrical distribution system as claimed in claim 12, wherein each said flap is of sufficient length to allow passage of the head element of said connecting plug through the aperture and into the interior of the conduit, but is shorter than the overall width of the plug body when the plug is rotated into its contact position, whereby the opening revealed by the flap when the plug is fitted into the conduit is completely covered by the plug body.

14. An electrical distribution system as claimed in claim 5, wherein the conduit is formed from electrically conductive material and the plug is provided with an earth contact pin adapted to be held in contact with a conduit wall when said plug is in its contact position, and an electrically insulating support is provided within the conduit for supporting the continuous conductors.

15. An electrical distribution system, comprising the combination of a hollow conduit having disposed therein a plurality of continuous electrical conductors, a longitudinally-extending aperture in one wall of the conduit to allow access to the interior thereof at any one of a number of locations, and gate means located within the conduit and being movable from a normally closed position in which the gate means closes off that part of the interior of the conduit containing the conductors from that part of the conduit in which the aperture is located to an open position in which access to the conductors via the aperture can be achieved, said one wall of the conduit including a plurality of passageways therein, each of which passageways extends transverse to said aperture and communicates with one of said gate means, and a connecting plug having an element adapted for insertion through the aperture and which includes a plurality of electrical contact pins, said plug further having a projection adapted to be received within one of said passageways and engagable with one of said gate means upon insertion of said element through the aperture whereby insertion of said element through the aperture opens the gate means and rotation of the plug causes said contact pins to contact the respective conductors within the conduit.

16. An electrical distribution system as claimed in claim 15, wherein the plug body is formed from at least two separable parts one of which is provided with said contact pins, and core connectors means are located in the plug body adapted to provide for the connection of electrical cores to at least one of said contact pins, said core connector means comprising a cutting element of electrically conductive material adapted to cut through the insulating sleeve of an electrical cable or cord and to make electrical contact with the conductor core therein.

17. An electrical distribution system as claimed in claim 16, wherein the cutting element is adapted to cut through the insulating outer sleeve and make electrical contact with the conductor core when the cable is pushed into contact therewith, and the parts of the plug body are shaped to perform this operation when the plug is assembled.

18. An electrical distribution system as claimed in claim 16, wherein one of the body parts is provided with at least two contact pins and a corresponding number of cutting elements each connected to a respective contact pin, and the second body part comprises a removable cover adapted to force a conductor core into contact with the cutting elements when the cover is closed.

19. An electrical distribution system as claimed in claim 18, wherein the cutting elements comprise substantially V-shaped cutting teeth adapted to receive a sleeved core between their converging cutting edges, and projection means are provided on the cover adapted when the cover is closed to force the cable into cutting contact with the teeth.

20. An electrical distribution system as claimed in claim 19, wherein said projection means comprise similar V-shaped cutting teeth to those provided on the other body part, adapted when the cover is assembled to engage the sleeved core at a point immediately adjacent the corresponding cutting teeth in the said other body part.

21. An electrical distribution system as claimed in claim 16, wherein cable grip means are located between the body parts comprising a hollow frusto-conical member of resilient material which is adapted to receive a covered electrical cable along its central axis, and axial slots are provided in the wall of the frusto-conical member around the narrowest part thereof so as to form said wall into segments adapted to grip the outer covering of the cable and prevent the cable being pulled axially through the member in direction of convergence of the walls thereof.

22. An electrical distribution system as claimed in claim 21, wherein said member is formed in two parts each located in respective body parts of the plug body.

23. An electrical distribution system, comprising a hollow conduit, a plurality of continuous electrical conductors disposed within the conduit, a longitudinally-extending aperture in one wall of the conduit to allow access to the interior thereof at any one of a number of locations, gate means located within the conduit and being movable from a normally closed position in which the gate means closes off that part of the interior of the conduit containing the conductors from that part of the conduit in which the aperture is located, to an open position in which access to the conductors via the aperture can be achieved, a connecting plug having an element adapted for insertion through the aperture and which includes a plurality of electrical contact pins, whereby insertion of said element through the aperture opens the gate means and rotation of the plug causes said contact pins to contact the respective conductors within the conduit, said connecting plug comprising a plug body, a neck portion protruding from the plug body, and a head member extending substantially at right angles to the neck portion, said electrical contact pins being disposed at the free end of said head member for contact with the conductors, said one wall of the conduit containing the aperture being provided at intervals along its length with passageways communicating with the interior of the conduit, said connecting plug being formed with a corresponding projection, whereby when the plug is inserted into the aperture, said projection is engaged with a passageway and said gate means is opened by abutment with said projection.

24. An electrical distribution as claimed in claim 23, wherein the gate means comprises a series of individually movable and juxtaposed cover plates each of which is located within the conduit opposite one of said passageways.

25. An electrical distribution as claimed in claim 24, wherein said individual cover plates are formed from a continuous strip of resilient material divided at intervals along its length.

26. An electrical distribution as claimed in claim 23, wherein said passageways are formed in the respective wall of the conduit immediately adjacent the edge of the aperture nearest the conductors, and said passageways extend into the aperture.

27. An electrical distribution system as claimed in claim 24, wherein door means are provided adapted to extend in their closed position across said continuous slot, and said door means comprise a series of individual cover flaps corresponding in number and position to said gate means, and said cover flaps are biased into their closed position by spring means.

28. An electrical distribution system as claimed in claim 27, wherein each said flap is of sufficient length to allow passage of the head element of said connecting plug through the aperture and into the interior of the conduit, but is shorter than the overall width of the plug body when the plug is rotated into its contact position, whereby the opening revealed by the flap when the plug is fitted into the conduit is completely covered by the plug body.

* * * * *